US007059340B2

(12) United States Patent
Hecking

(10) Patent No.: US 7,059,340 B2
(45) Date of Patent: Jun. 13, 2006

(54) VALVE ASSEMBLY FOR PIPE DISCONNECTORS

(75) Inventor: Willi Hecking, Mönchengladbach (DE)

(73) Assignee: Hans Sasserath & Co KG, Fed Rep (DE)

( * ) Notice: Subject to any disclaimer, the term of this patent is extended or adjusted under 35 U.S.C. 154(b) by 257 days.

(21) Appl. No.: 10/406,953

(22) Filed: Apr. 2, 2003

(65) Prior Publication Data

US 2004/0035467 A1 Feb. 26, 2004

(30) Foreign Application Priority Data

Apr. 3, 2002 (DE) ..... 102 14 747
Feb. 27, 2003 (DE) ..... 103 08 838

(51) Int. Cl.
*G05D 11/00* (2006.01)
*F16K 24/02* (2006.01)

(52) U.S. Cl. ..... 137/115.16; 137/218; 137/512

(58) Field of Classification Search ..... 137/218, 137/115.16, 115.2, 512, 614.2
See application file for complete search history.

(56) References Cited

U.S. PATENT DOCUMENTS

| | | | | |
|---|---|---|---|---|
| 3,747,621 | A | 7/1973 | Tine | |
| 3,818,929 | A * | 6/1974 | Braukmann | 137/218 |
| 4,013,089 | A | 3/1977 | Braukmann | |
| 4,159,025 | A * | 6/1979 | Harthun | 137/512 |
| 4,518,006 | A * | 5/1985 | Hoffmann et al. | 137/218 |
| 4,991,622 | A * | 2/1991 | Brewer et al. | 137/512 |
| 5,127,436 | A * | 7/1992 | Campion et al. | 137/614.2 |
| 5,207,242 | A * | 5/1993 | Daghe et al. | 137/512 |

(Continued)

FOREIGN PATENT DOCUMENTS

| | | |
|---|---|---|
| AU | 606 060 | 11/1987 |

(Continued)

OTHER PUBLICATIONS

"Water Regulations Guide" issued by WRAS, 6.14.

(Continued)

*Primary Examiner*—John Rivell
(74) *Attorney, Agent, or Firm*—Thorpe North & Western LLP

(57) ABSTRACT

The invention relates to a valve assembly of a pipe disconnector for separating a service water system which is arranged to be filled or re-filled from a drinking water system, comprising upstream and downstream backflow preventers which both close in the direction from the service water system to the drinking water system, and a relief valve, which is exposed to the pressure of the drinking water system in closing direction and which is adapted to connect the space between the backflow preventers to a drain, when this pressure ceases. A pipe disconnector is to be provided, which is easy to clean and to service. Furthermore, a valve assembly is to be provided which can be used equally for pipe disconnectors of the type CA and for pipe disconnectors of the type BA. This is achieved in that the backflow preventers and the relief valve are combined to form a structural unit which is designed to be removed from and set in, as a whole, into a pipe disconnector casing having connections for drinking water and service water and the drain. The relief valve comprises a slide valve body, which, at one end face, is exposed to the drinking water pressure and, at the opposite end face, is exposed to the pressure in a space between the backflow preventers, and which is arranged to cover, in its closed position, a lateral outlet opening of the pipe disconnector casing, which opening communicates with the outlet.

10 Claims, 11 Drawing Sheets

U.S. PATENT DOCUMENTS

| | | | | |
|---|---|---|---|---|
| 5,960,818 | A * | 10/1999 | Hecking | 137/218 |
| 6,021,805 | A * | 2/2000 | Horne et al. | 137/512 |
| 6,178,998 | B1 | 1/2001 | Ochiai et al. | |
| 6,546,946 | B1 * | 4/2003 | Dunmire | 137/512 |

FOREIGN PATENT DOCUMENTS

| | | |
|---|---|---|
| CA | 1030423 | 5/1978 |
| DE | 71 08 532 U | 5/1971 |
| DE | 24 24 978 | 12/1975 |
| DE | 42 31 494 | 2/1994 |
| DE | 100 29 656 | 1/2001 |
| DE | 101 28 435 A1 | 12/2002 |
| EP | 0 183 909 | 6/1986 |
| EP | 0 972 995 A1 | 1/2000 |
| EP | 1 004 715 A1 | 5/2000 |
| WO | WO 95/00784 | 1/1995 |

OTHER PUBLICATIONS

"Water Regulations Guide" issued by WRAS, 6.15.

* cited by examiner

VALVE ASSEMBLY FOR PIPE DISCONNECTORS

FIELD OF INVENTION

The invention relates to a valve assembly of a pipe disconnector for separating a service water system which is arranged to be filled or re-filled from a drinking water system, comprising upstream and downstream backflow preventers which both close in the direction from the service water system to the drinking water system, and a relief valve, which is exposed to the pressure of the drinking water system in closing direction and which is adapted to connect the space between the backflow preventers to an outlet, when this pressure ceases.

BACKGROUND OF THE INVENTION

The service water system may, for example, be a heating system. Such a heating system is filled or re-filled from a drinking water system, the drinking water supply. It has to be ensured, at all events, that water does not flow from the service water system back into the drinking water system, for example in the case of pressure drop in the drinking water system. To this end, "backflow preventers" are provided. These backflow preventers are spring loaded check valves, which, under the influence of the drinking water pressure open only in the direction from the drinking water system towards the service water system. Also this, however, is not regarded as sufficient for continuous operation. Rather is a physical separation between the drinking water system and the service water system prescribed, for example by filling or re-filling through a hose which is removed, after the filling or re-filling process has been completed. This ensures that no service water can get into the drinking water system even in the case of leaking shut-off valves or backflow preventers.

As the removal of the hose after the filling or re-filling process is troublesome and, in addition, cannot be checked, fixed installations of pipe disconnectors are known (for example EP 0,972,995 A1). These known pipe disconnectors comprise an upstream backflow preventer, i.e. a backflow preventer installed on the side of the drinking water system, and a downstream backflow preventer, i.e. a backflow preventer installed on the side of the service water system. Both backflow preventers open in the direction towards the service water system. A pressure controlled relief valve is provided between the backflow preventers. This relief valve is controlled by the drinking water pressure and opens automatically, when the drinking water pressure breaks down or drops. Thus, if the service water system is filled or re-filled and a service water pressure sufficient therefor is present, then the relief valve is closed by this pressure. Drinking water flows through the backflow preventer pushed open by the drinking water pressure and into the service water system. If the drinking water pressure drops below a predetermined level, either because a shut-off valve shuts off the drinking water system or because the drinking water pressure breaks down for one reason or another, the relief valve will open. Even if then service water flows back from the service water system through a leaking backflow preventer, this service water flowing back is drained through the outlet and, by no means, can get into the drinking water system.

In a prior art design, the relief valve has a sleeve-shaped valve closure body, which cooperates with an annular valve seat on a substantially tubular pipe disconnector casing. The valve closure body is biased by a spring in the direction towards the open position. The backflow preventers and the valve closure body are arranged coaxial within the pipe disconnector casing. The valve closure body is supported non-positively on a plate displaceably guided in the pipe disconnector casing, the loading spring of the upstream backflow preventer being, in turn, supported upstream on this plate. When sufficiently high pressure is present in the drinking water system, the valve closure body is pressed on the valve seat through displaceable plate against the action of the spring. Then the upstream backflow preventer is pushed open. The inflowing drinking water pushes the downstream backflow preventer ("Water Regulations Guide" issued by WRAS, 6.15).

In the prior art pipe disconnectors, the pressure situation is not exactly defined and cannot be verified. The movement of the valve closure body into its open position is effected only by the spring acting on the valve closure body, this spring having to keep the valve closure body in non-positive engagement with the plate, if this plate yields.

These so-called pipe disconnectors of the type CA are intended for a certain risk class of the service water. There are service water classes having a higher level of contamination and involving a correspondingly higher risk. The pipe disconnectors described above are regarded as insufficient for the separation of such service water from the drinking water. Here, the standards demand pipe disconnectors of the so-called type BA providing increased safety.

This is achieved by providing a median pressure zone between the upstream and downstream backflow preventers, the relief valve being differential pressure-controlled by the pressure difference between drinking water system and the median pressure zone. This ensures, with each hydraulic situation, that a pressure drop from the drinking water system to the median pressure zone exists. In known manner, the relief valve is controlled by a diaphragm, across which the pressure difference acts. If service water enters the median pressure zone, the pressure in the median pressure zone will rise, and the relief valve will open to maintain a constant pressure difference ("Water Regulations Guide", issued by WRAS, 6.14)

With the pipe disconnectors of the type BA, test taps for the connection of pressure gauges are provided, by means of which the pressures of drinking water and service water and the "medium pressure" in the space between the backflow preventers can be measured.

The prior art pipe disconnectors with differential pressure-controlled relief valve are of expensive construction. Cleaning and servicing is difficult, because the individual components are not, or only with difficulties, accessible. Basically different valve assemblies are used for pipe disconnectors of the type CA and for pipe disconnectors of the type BA.

A company brochure "SYR Füllgruppe Typ 2128" of Hans Sasserath & Co. KG, describes a filling unit, which is permanently installed at a service water system such as a closed hot water heating installation and has a connector for connection of a hose. The filling unit can be connected to a drinking water system through a hose to be connected to this connector. This filling unit includes a backflow preventer, a shut-off valve and a pressure reducer.

DISCLOSURE OF THE INVENTION

It is an object of the invention to provide a pipe disconnector which is easy to clean and to service.

A further object of the invention is to provide a valve assembly which can be used equally for pipe disconnectors of the type CA and for pipe disconnectors of the type BA.

To this end, the backflow preventers and the relief valve are combined to form a structural unit which is designed to be removed from and set into, as a whole, a pipe disconnector casing having connections for drinking water and service water and the outlet. The relief valve comprises a slide valve, which, at one end face, is exposed to the drinking water pressure and, at the opposite end face, is exposed to the pressure in a space between the backflow preventers, and which is arranged to cover, in its closed position, a lateral outlet opening or drain passage of the pipe disconnector casing.

Thus, the relief valve is a slide valve. The slide valve body is guided, in well defined way, in seals, between which the lateral outlet opening branches off. The slide valve body provides well defined end faces in each of its positions. One end face is exposed to the pressure of the drinking water system, the other end face is exposed to the median pressure from the space between the backflow preventers. The seals determine the areas on which the pressures act and which, preferably, are equal. The slide valve body is urged towards its open position by a loading spring. The median pressure has to be always lower than the pressure in the drinking water system by an amount determined by the loading spring. The backflow preventers and the slide valve body are coaxial. The upstream backflow preventer is fixedly mounted in the slide valve body. The backflow preventers and the slide valve body form an integral unit of generally cylindrical form. Such a unit can be inserted into a pipe disconnector casing, which has a correspondingly cylindrical recess, seals therein and the lateral outlet or drain openings therebetween, which are governed by the slide valve body. The pipe disconnector casing may be a simple, substantially tubular casing. Then a pipe disconnector of the type CA is obtained. The same unit can, however, also be inserted into a different pipe disconnector casing having test taps for making a pipe disconnector of the type BA. Also this pipe disconnector casing for a type BA pipe disconnector becomes simpler than in the prior art. Furthermore, there is the advantage that the whole valve assembly with backflow preventers and slide valve body can conveniently be removed for servicing as integral unit.

Embodiments of the invention are described hereinbelow with reference to the accompanying drawings.

PREFERRED EMBODIMENTS OF THE INVENTION

The two pipe disconnectors of FIGS. 1 to 4, on one hand, and of FIGS. 5 to 9, on the other hand, have a valve assembly 10 (FIGS. 2 and 6) in common, which is constructed as an integral unit 10. This unit 10 is of generally cylindrical shape. The unit 10 can be removably inserted either into a substantially tubular pipe disconnector casing 12 (FIGS. 1 to 4) or into a casing 14 (FIGS. 5 to 9). In the former case, a pipe disconnector of the type CA is obtained, in the latter case, a pipe disconnector of the type BA will result.

Figure 1:
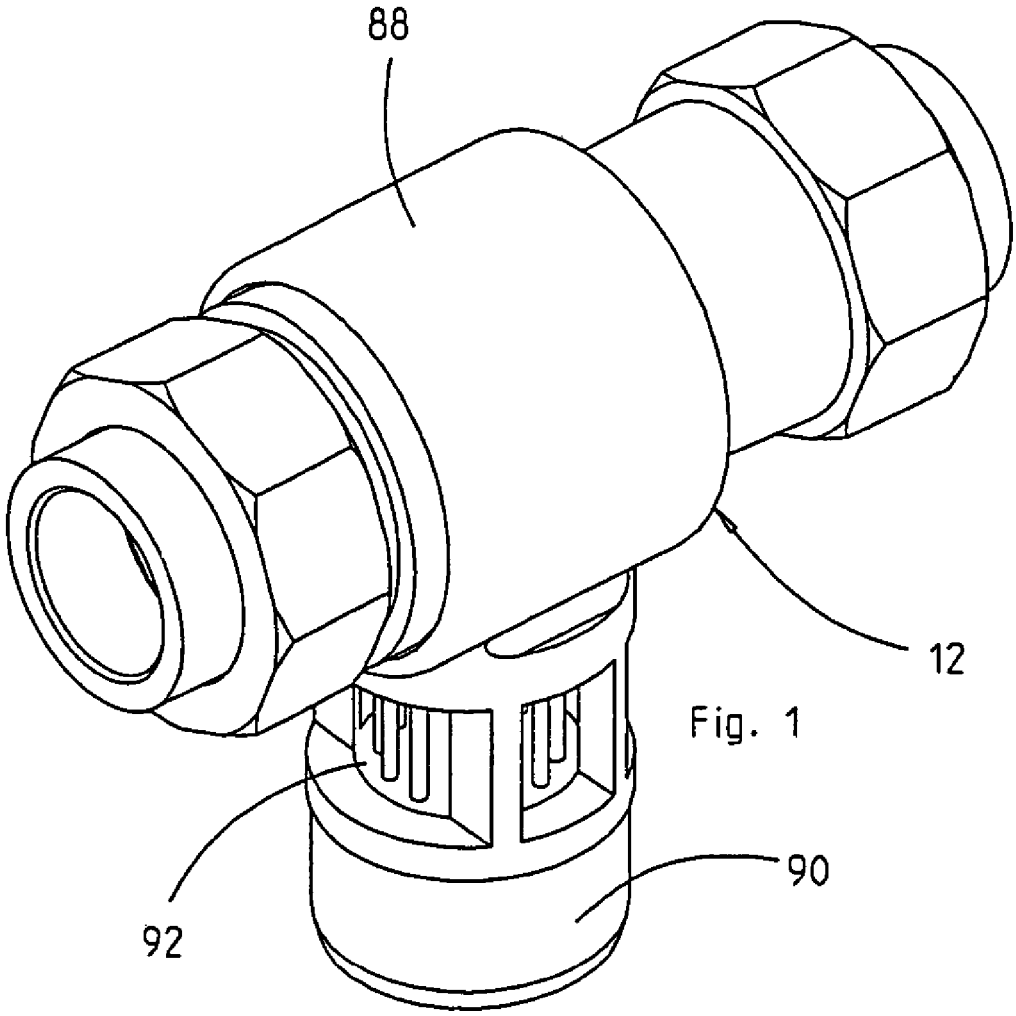
FIG. 1 is a perspective view of a simple pipe disconnector of the type CA.
Figure 2:
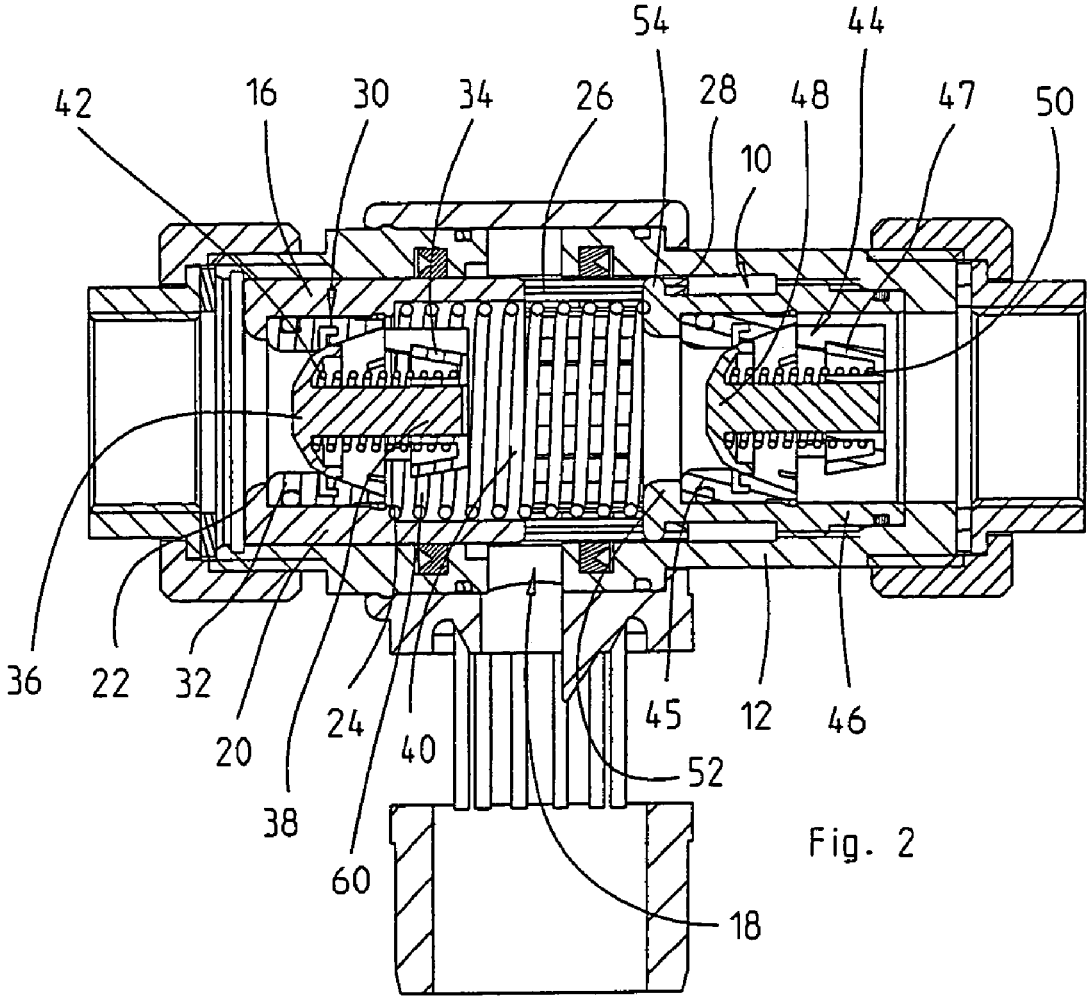
FIG. 2 is a longitudinal sectional view of the pipe disconnector of FIG. 1, the relief valve being in its open position.

Referring to FIG. 2, numeral 16 designates a slide valve body. The slide valve body 16 forms part of a relief valve 18. The slide valve body 16 forms a cylindrical sleeve 20. The sleeve 20, at its upstream end (at the left in FIG. 2), has an inwardly projecting flange 22. The inner wall of the sleeve 20 forms a step 24. At its downstream end, the sleeve has spaced resilient fingers 26 integral therewith in a uniform array. At their ends, the resilient fingers 26 have inwardly projecting lugs 28. Because of their resiliency, the fingers are biased inwardly to the positions shown in FIG. 4, and by their resiliency, are considered spring biased.

An upstream backflow preventer 30 is mounted in the sleeve 20 of the slide valve body 16. The backflow preventer 30 has a valve seat 32. The valve seat 32 engages the flange 22. A spring abutment 34 is connected with the valve seat 32 through webs. A mushroom-shaped valve closure body 36 has a shaft 38 guided in a central aperture of the spring abutment 34. A helical spring 42 is supported on the spring abutment 34 and urges the valve closure body 36 against the valve seat 32. Such a backflow preventer is a conventional component and usually made of plastics. The valve closure body 36 can be pushed open by pressure in the drinking water system and permits water flow to a service water system. If a backflow occurs, the backflow preventer 30 will close and will prevent service water from entering the drinking water system.

A downstream backflow preventer 44 is mounted in a cylindrical jacket 46. The backflow preventer 44 is of substantially identical design as the upstream backflow preventer 30. The backflow preventer 44 has a valve seat 45 and a spring abutment 47 connected therewith, as well as a mushroom-shaped valve closure body 48. The valve closure body 48 is urged against the valve seat 45 by a helical spring 50 which is supported on the spring abutment 47. The downstream backflow preventer 44 opens for flow towards the service water system and prevents backflow out of the service water system. The valve seat 45 engages an inwardly projecting collar 52 of the jacket 46.

The jacket 46 has an outwardly extending flange 54. The flange 54 is crenellated and has a circular array of equally spaced radial projections 56 and gaps 58 (FIG. 4) therebetween. The resilient fingers 26 of the slide valve body 16 extend between the projections 56 through the gaps 58. Their lugs 28 snap behind the inner portion of the flange 54. A helical spring 60 (FIG. 2) is supported on the flange 54 and engages the step 24 at the inner wall of the sleeve 20.

Figure 3:
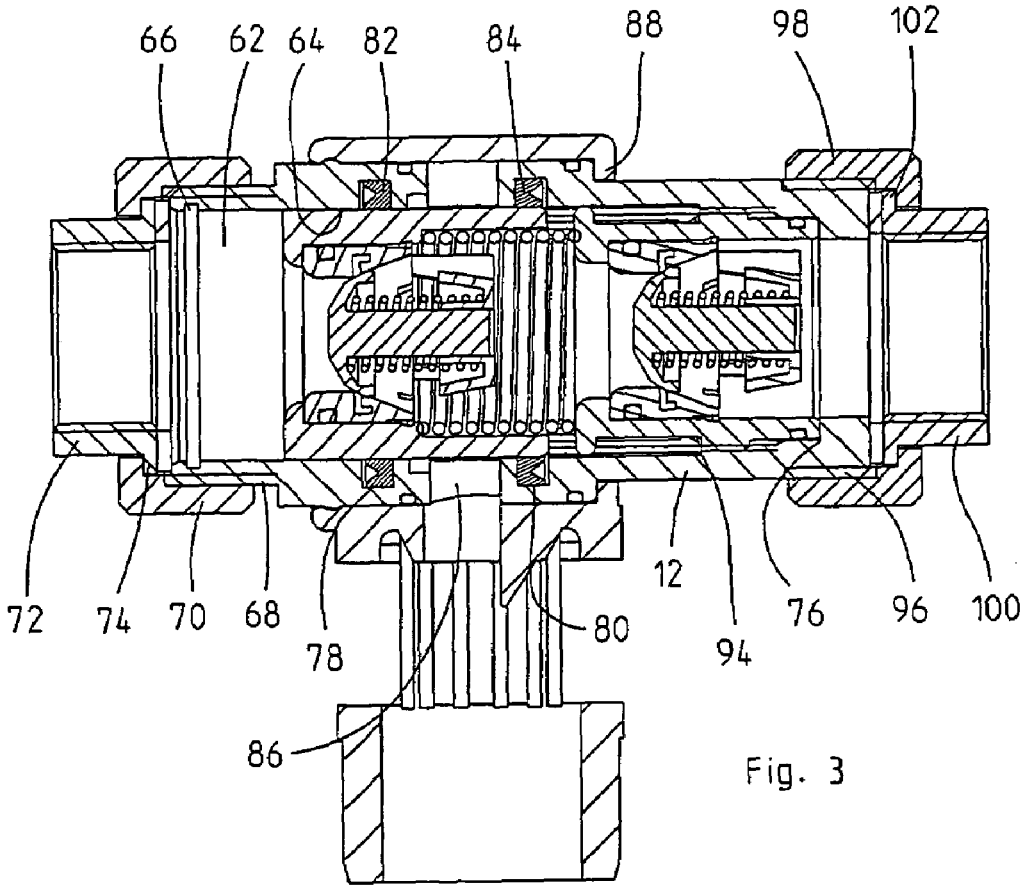
FIG. 3 is a longitudinal sectional view of the pipe disconnector similar to FIG. 2, the relief valve, however, being in its closed position.
Figure 4:
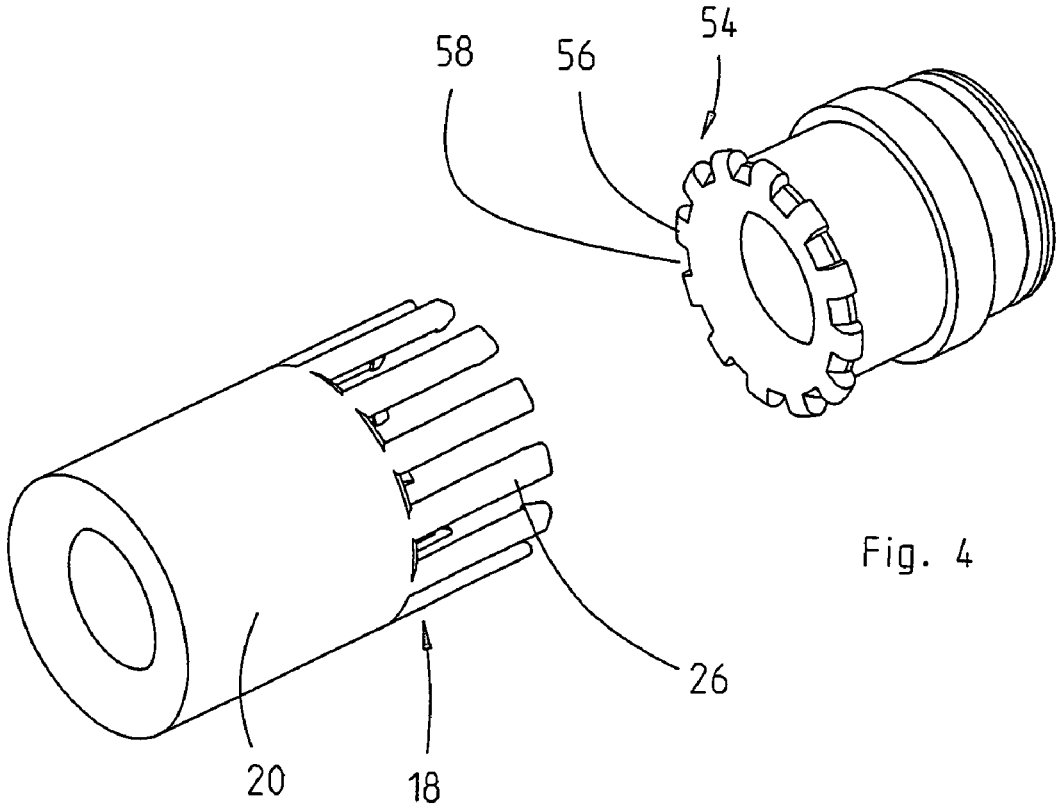
FIG. 4 is a perspective illustration of a detail.
Figure 5:
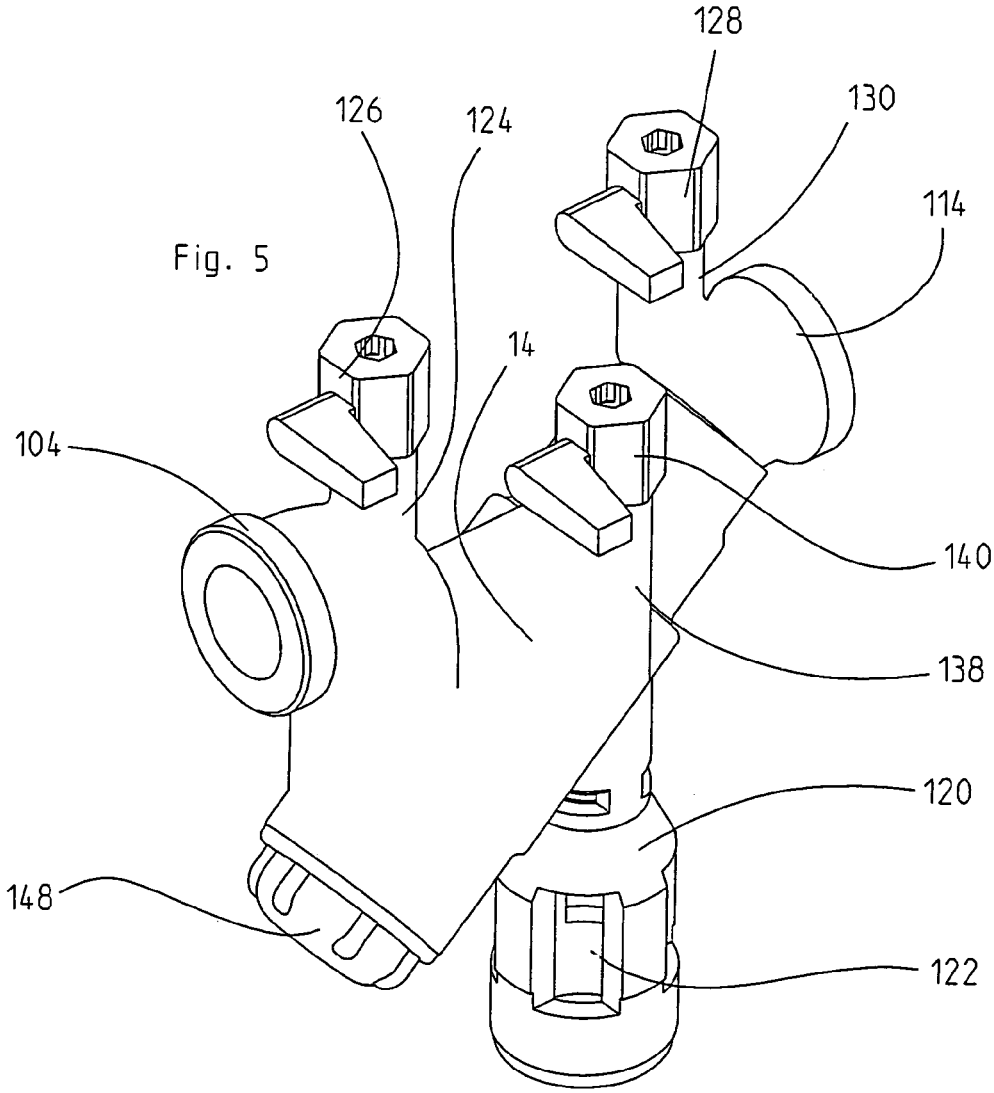
FIG. 5 is a perspective view of a pipe disconnector of the type BA with test taps for checking the various pressures.

Thereby, the slide valve body 16 and the downstream backflow preventer 44 are urged apart by the helical spring 60, until the lugs 28 engage the flange 54. The slide valve body 16 can be pushed to the right in FIG. 2 against the action of the helical spring 60, as illustrated in FIG. 3. During this movement, the resilient fingers 26 are guided between the crenellated projections 56.

The bias of the helical spring 42 is larger than the bias of the helical spring 60. Therefore, the upstream backflow preventer 30 opens under the pressure in the drinking water system against helical spring 42 not before the slide valve body 16 has been moved to the right in FIG. 2 against the action of the helical spring 60, as illustrated in FIG. 2. In contrast thereto, the helical spring 50 of the backflow preventer 44 is comparatively weak.

In this way, the valve assembly forms a self-contained, integral unit, which can be inserted as a whole into an appropriate pipe disconnector casing and can be removed therefrom, if required, for servicing.

In the embodiment of FIGS. 1 to 4, such a valve assembly is installed in a generally tubular casing 12 for making a pipe disconnector of the type CA.

The casing 12 defines a casing bore 62 (FIG. 3) having a cylindrical inner wall 64. A snap ring 66 which is engaged by the end face of the sleeve 20 secures the valve assembly at the left in FIG. 2 within the casing bore 62. A threaded socket 68 accommodates a cap nut 70, which tightens a pipe connection 72 with a flange 74 against the end face of the casing 12. The inner wall 64 defines a step 76 downstream, at the right in FIG. 3. The jacket 46 engages the step 76.

Two circumferential grooves 78 and 80 are provided in the inner wall 64 of the casing 12. Seals 82 and 84 are retained in these circumferential grooves 78 and 80, respectively. The seals engage the peripheral surface of the slide valve body 16. Thereby, a well defined area is established, on which pressures act on the slide valve body 16. Lateral outlet or drain opening 86 are formed between the seals. A ring 88 extends around the casing 12 and is sealingly guided on the casing 12. An outlet or drain socket 90 is provided on the ring 88. The outlet or socket is vented to atmosphere through lateral openings 92. The ring 88 permits the outlet socket to extend always downwards independently of the angular position of the casing 12.

The inner wall 64 of the casing has a further step 94, which is engaged by the fingers 26, when the spring 60 is compressed.

At the right end in FIGS. 2 and 3, the casing, again, has a thread 96, on which a cap nut 98 is screwed. The cap nut tightens a pipe connector 100 with a flange 102 against the end face of the casing 12.

The described pipe disconnector operates as follows:

If the pipe disconnector is connected with the drinking water system, for example by opening a filling valve, then the normally high pressure of the drinking water system acts on the left end face in FIG. 2 of the slide valve body, while atmospheric pressure prevails, at first, on the right side of the slide valve body. The backflow preventer 30, at first, remains closed. The slide valve body 16 is pushed to the right in FIG. 2 against the action of the helical spring 60 up to a position illustrated in FIG. 3. During this movement, the fingers 26 slide between the projections 56 and are guided thereby. The sleeve 20 slides over the seal 84 and covers the outlet opening 86. Now the upstream backflow preventer 30 opens. The entering drinking water pushes open the downstream backflow preventer 44, which is loaded by weaker spring 50. Now drinking water can flow into the service water system, until the service water system has been filled and the downstream backflow preventer 44 is closed.

If the pressure in the drinking water system drops, the upstream backflow preventer 30 will be closed first. Then the slide valve body 16 is pushed back by the helical spring 60 and opens the outlet opening 86. The same happens, if the pressure in the service water system rises for one reason or other and an increased median pressure builds up through a leaking downstream backflow preventer 44 in the space between the backflow preventers 30 and 44. This will have the result that the pressure difference between the pressure in the drinking water system and the median pressure is no longer sufficient to overcome the spring force of the helical spring 60. This ensures that this pressure difference never drops below a value determined by the helical spring 60 and, therefore, no service water can be pressed back into the drinking water system.

In the embodiment of FIGS. 5 to 9, the unit 10 described above is mounted in a different pipe disconnector casing 14.

Figure 6:
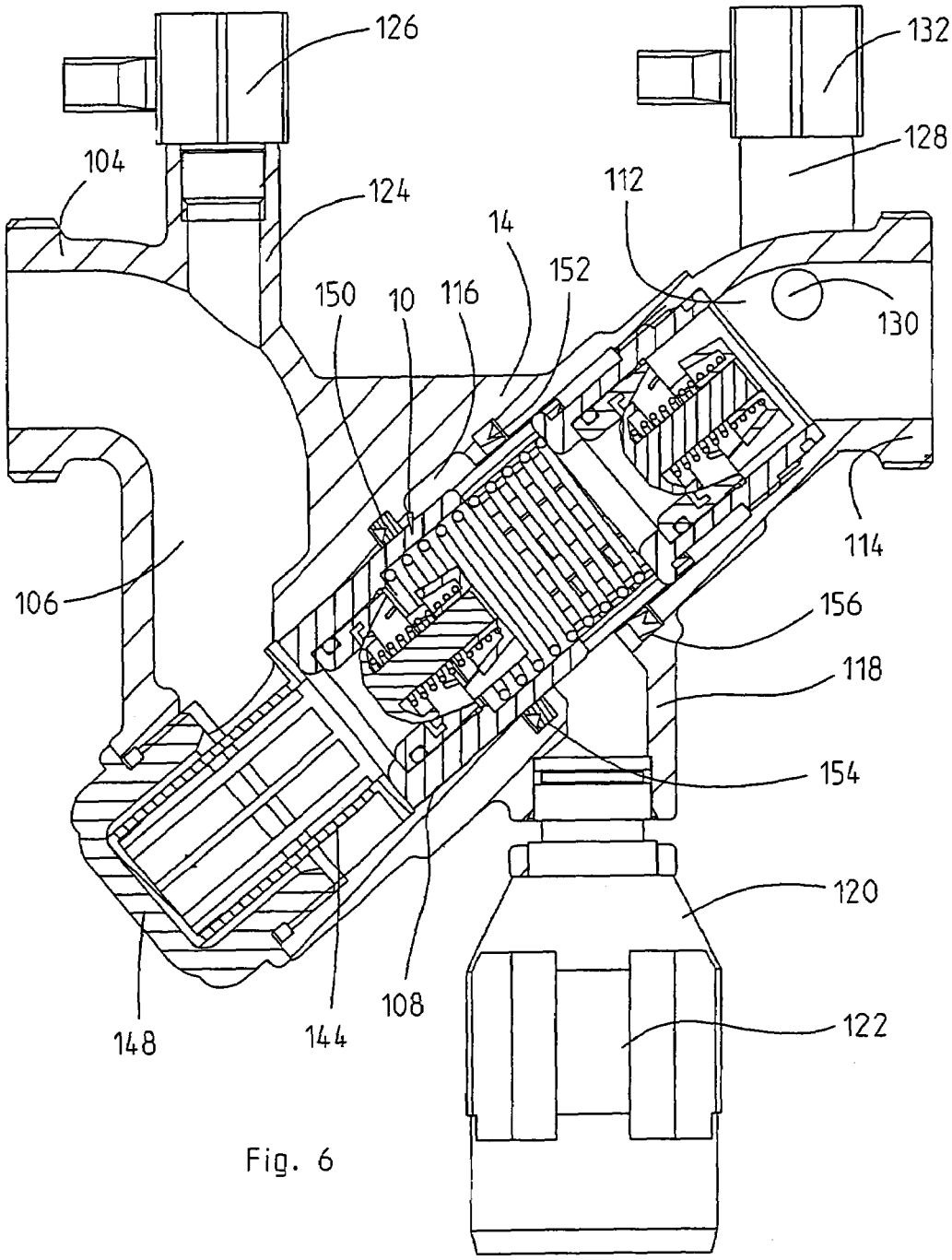
FIG. 6 is a longitudinal sectional view of the pipe disconnector of FIG. 5, the relief valve being in its open position.
Figure 7:
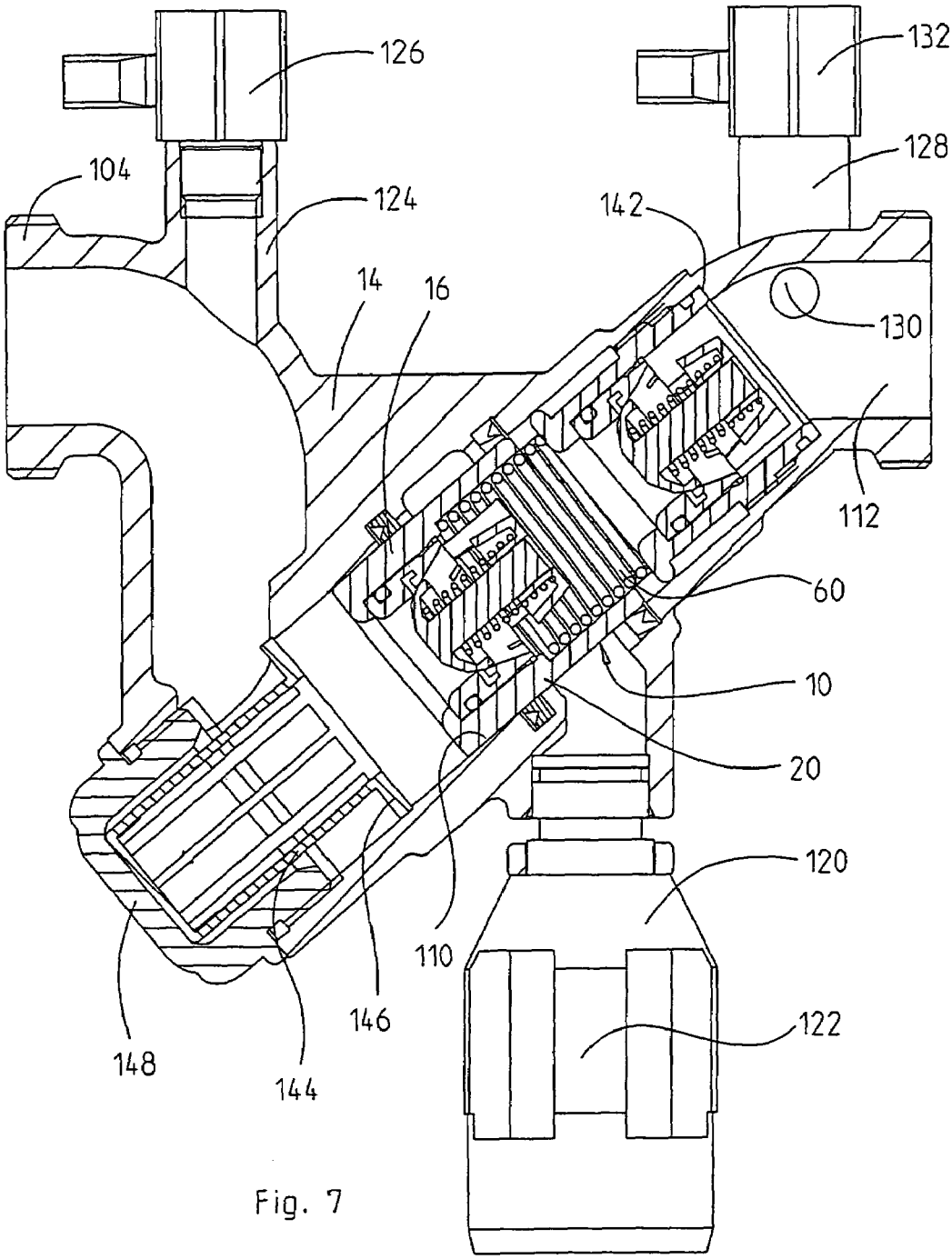
FIG. 7 is a longitudinal sectional view of the pipe disconnector similar to FIG. 5, the relief valve, however, being in its closed position.
Figure 8:
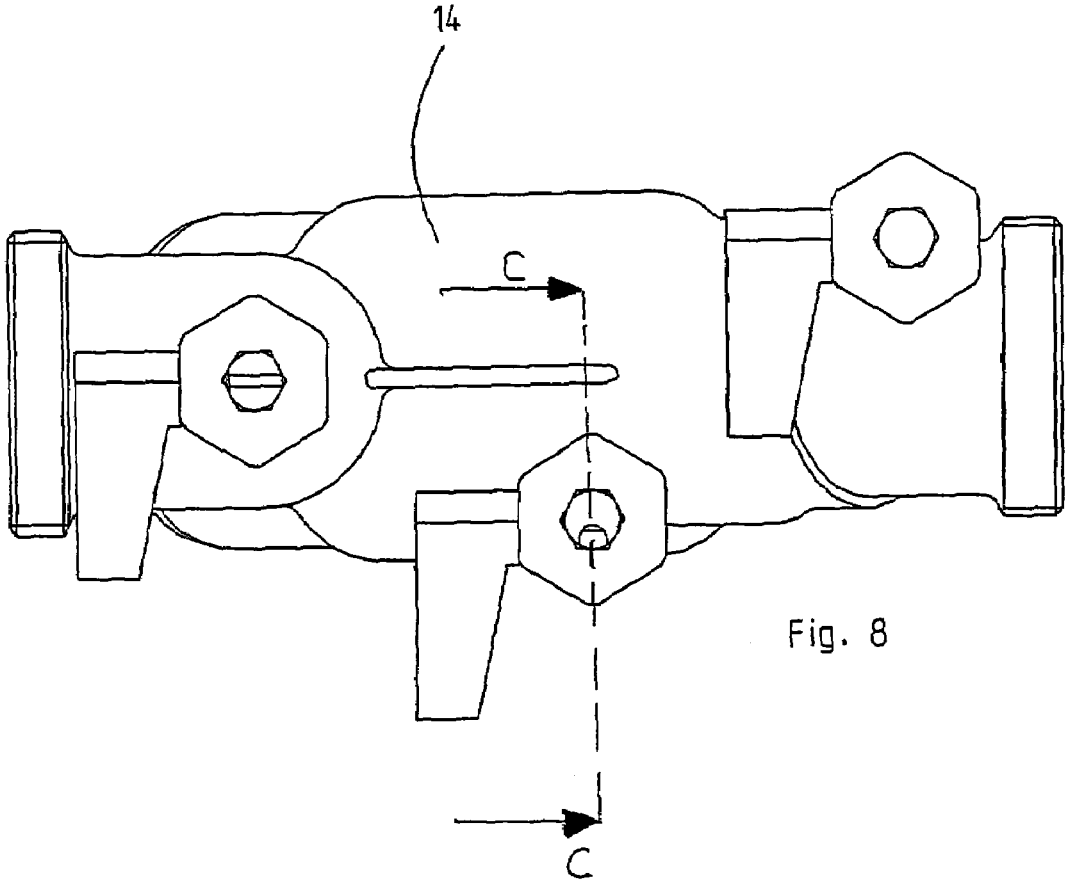
FIG. 8 shows a plan view of the pipe disconnector of FIGS. 5 to 7.
Figure 9:
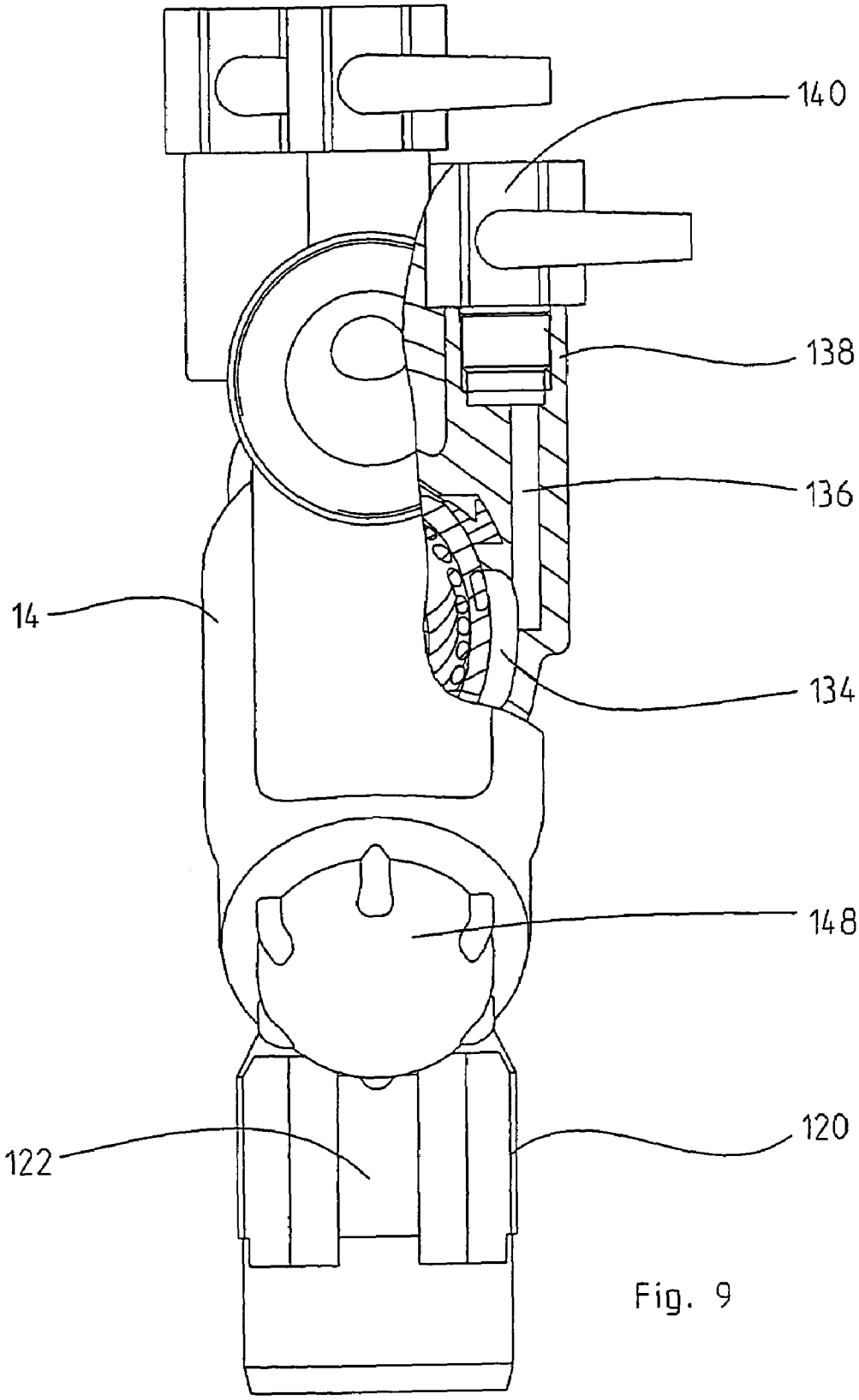
FIG. 9 is a sectional view taken along line C—C of FIG. 8.

The pipe disconnector casing 14 has an inlet socket 104, which is horizontal in FIG. 6. The inlet 104 communicates with an inlet passage 106, which is curved towards the bottom by 90°. The inlet passage opens into a bore 108 with a substantially cylindrical inner wall 110, the bore being inclined towards the top. At its upper end, the bore communicates with an outlet passage 112, which is connected with an outlet socket 114. Inlet socket 104 and outlet socket 114 are coaxial, so that the pipe disconnector casing 14 can be installed in a straight pipeline. In its central section, the bore 108 has an increased diameter to form an annular chamber 116. A downwardly extending outlet socket or drain passage 118 branches off from the annular chamber 116. An outlet element 120 is mounted in the outlet socket 118 and communicates with atmosphere through lateral openings 122, similar to the outlet socket 90 in FIG. 1.

A test tap 124 branches off from the inlet passage 106 and extends upwards, the test tap being normally closed by a valve 126. A pressure gauge can be connected to this test tap 124 for measuring the pressure in the inlet passage, thus the pressure in the drinking water system. A test tap 128 extending to the top is connected to the outlet passage 112 through a passage 130. The test tap 128 is normally shut off by a valve 132. A pressure gauge can be connected to this test tap 128 for measuring the pressure in the outlet passage 112, thus the pressure in the service water system.

In the inner wall 110 of the bore 108, a channel 134 (FIG. 9) extending along the bore and being open towards the bore is formed. The channel communicates with an upwardly extending test tap 138, through a connecting passage 136. The test tap 138 is normally closed by a valve 140. A pressure gauge can be connected to the test tap 138 for measuring the "median pressure" between the backflow preventers.

A unit 10 of the described type is inserted into the bore 108 through the open end at the left and at the bottom in FIG. 6. The end face of the jacket 46 (FIG. 2) of unit 10 engages a step 142 between the bore 108 and the outlet passage 112. A filter 144 with a flange 146 is then installed in the bore 108. Then, the bore is closed by a screwed-in cap 148. With the relief valve open, the slide valve body 16, with the end face of the sleeve 20, engages the flange 146 of the filter 144 under the action of the helical spring 60.

Circumferential grooves 150 and 152 are provided in the inner wall 110 of the bore 108 on both sides of the annular chamber 116. Seals 154 and 156 are retained in these circumferential grooves 150 and 152, respectively.

The unit 10 is substantially identical with the valve assembly of FIGS. 2 and 3, both in structure and mode of operation, and, therefore, is not described in detail again. The annular chamber 116 and the seals 154 and 156 have the same functions as the outlet opening 86 and the seals 78 and 80 of FIG. 2. The casing 14 permits checking of the various occurring pressures and, thereby, also of the function of the pipe disconnector. The embodiment of FIGS. 5 to 9 is a pipe disconnector of the type BA.

Figure 10:
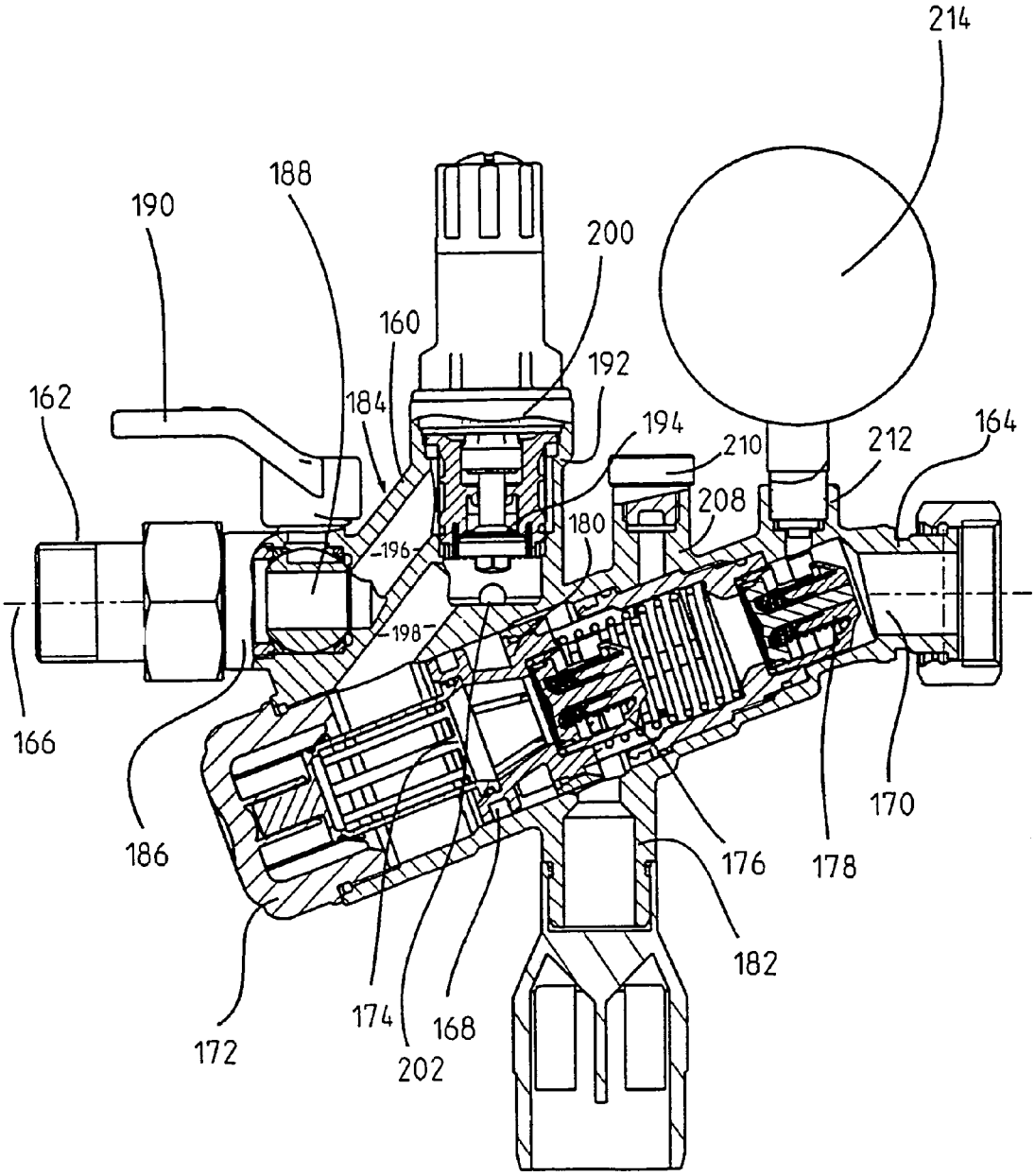
FIG. 10 is a sectional view of a modified pipe disconnector assembly similar to FIG. 5.
Figure 11:
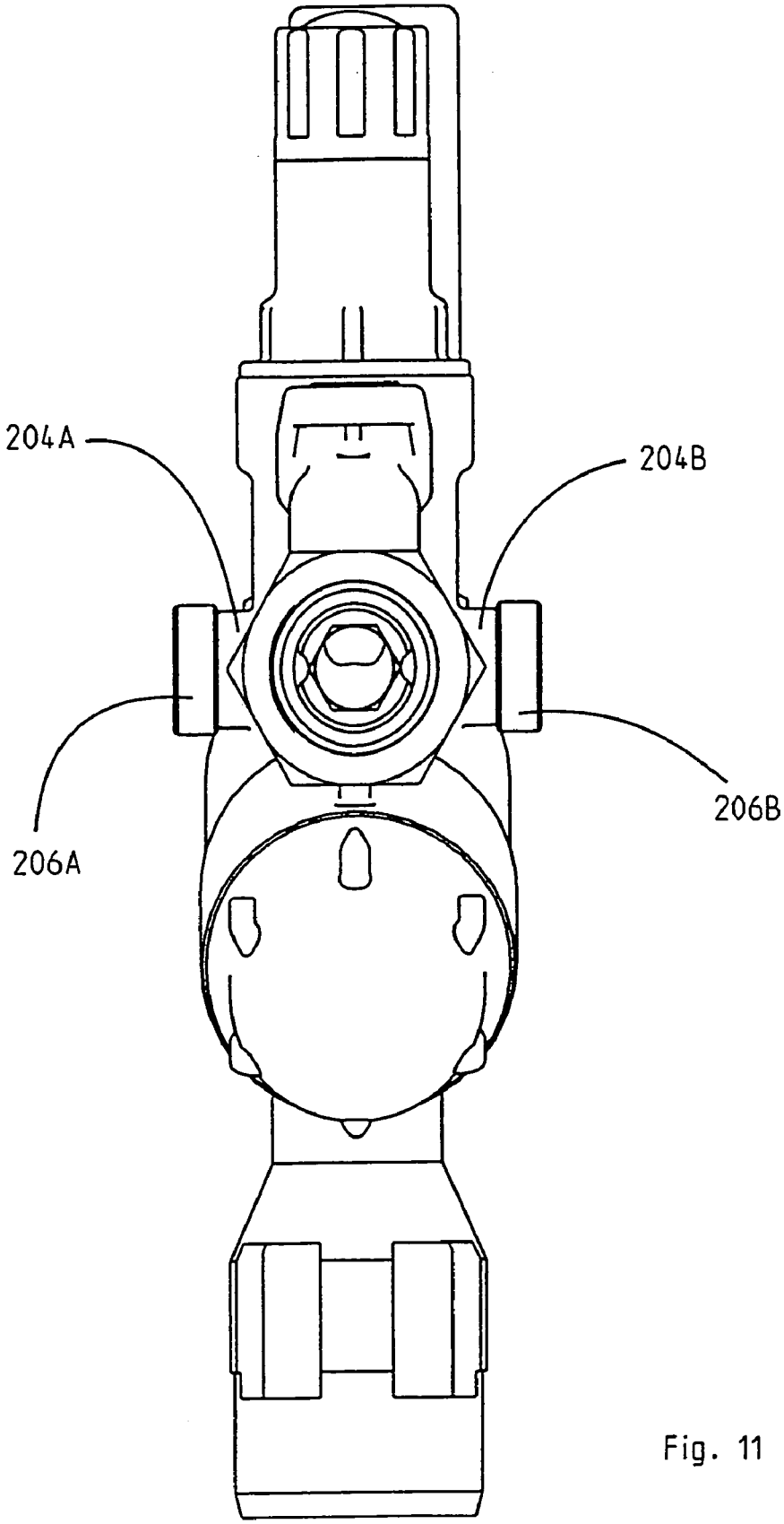
FIG. 11 is an end view from the left in FIG. 10.

FIGS. 10 and 11 show a modified embodiment similar to the embodiment of FIGS. 5 to 9 but being additionally provided with a shut-off valve and a pressure reducer.

In FIG. 10, numeral 160 designates a pipe disconnector casing. The pipe disconnector casing 160 has an inlet port 162 on an inlet side and an outlet port 164 on an outlet side. Inlet port 162 and outlet port 164 are coaxial on opposite sides of the pipe disconnector casing with a common port axis 166. An accommodation bore 168 is provided in the pipe disconnector casing 160. The bore axis of the accommodation bore 168 forms an acute angle with the port axis 166 of inlet port 162 and outlet port 164. On the outlet side, the accommodation bore 168 directly communicates with an outlet passage 170 of the outlet port 164. On the inlet side, the accommodation bore 168 is open and can be closed by a plug 172. The accommodation bore accommodates a pipe disconnector cartridge or unit 174 comprising an upstream backflow preventer 176, a downstream backflow preventer 178 and a relief valve 180 in the form of a slide valve arranged in the flow path therebetween. The backflow preventers 176 and 178 and the relief valve 180 are joined to form a unit which can be inserted into or removed from the accommodation bore 168, as a whole. The relief valve has a slide valve body, which, on one end face, is exposed to the drinking water pressure and, on the opposite end face, is exposed to the pressure in a space between the backflow preventers 176 and 178. A drain port or passage 182 branches off from the accommodation bore 168. The axis of the drain port extends in the plane defined by the port axis 166 and the axis of the accommodation bore 168 and at a right angle to the port axis 166. In its closed position, the slide valve body covers a lateral drain opening of the pipe disconnector casing, this opening being connected to the drain port 182.

The inlet-side end of the accommodation bore 168 is connected to an inlet passage 186 of the inlet port 162 through a connecting passage 184. A shut-off valve 188 in the form of a ball valve with an actuating handle 190 is arranged in the inlet passage.

The pipe disconnector casing 160 has a socket 192 integral therewith, the socket defining an accommodation cavity 194. The connecting passage 184 has two sections. A first section 196 extends from the inlet passage 186 downstream of the shut-off valve 188 to the accommodation cavity and opens into the upper portion of the cylindrical inner surface of the accommodation cavity 194. A second section 198 of the connecting passage extends from the lower portion of the cylindrical inner surface of the accommodation cavity 194 and opens into the accommodation bore 168 upstream of the upstream backflow preventer 176. A pressure reducer 200 designed as an integral unit is sealingly inserted into the accommodation cavity 194. The valve passage of the pressure reducer 200 governs the communication between the sections 196 and 198 of the connecting passage 184.

A transverse bore 202 connects the accommodation cavity 194 downstream of the control valve of the pressure reducer 200 with test taps 204A and 204B (FIG. 11), which permit connection of a pressure gage optionally on either side, depending on the installation of the filling unit. The test taps 204A and 204B are closed by plugs 206A and 206B, respectively. These test taps permit measurement of the pressure upstream of the upstream backflow preventer 176. A further test tap 208 (FIG. 10) branches off from the accommodation bore 168 between the upstream backflow preventer 176 and the downstream backflow preventer 178. The test tap 208 is closed by a plug 210. This test tap permits a pressure gage to be connected thereto for checking the pressure between the upstream and downstream backflow preventers. Eventually, a test tap 212 is provided, which branches off from the outlet passage 170. A pressure gage 214 is connected to this test tap 212.

The pipe disconnector assembly is permanently installed between the drinking water system and the service water system, such as a hot water central heating system. No hose connection needs to be established for filling or re-filling of the service water system. This facilitates the handling. Thanks to the relief valve 180 automatically opening, when the pressure difference between the drinking water system and the service water system ceases, mechanical disconnection of the systems is ensured in this case. A built-in pressure reducer 200 ensures that the pressure in the service water system cannot exceed a set value. When the pressure in the service water system reaches the pressure set at the pressure reducer, the valve of the pressure reducer 200 will close and interrupt the filling process, even if the pressure in the drinking water system should be higher. The pressure reducer 200 provides an additional safeguard against backflow into the drinking water system. By means of the shut-off valve 188, the filling process can be interrupted and the drinking water system can be separated, in normal operation, from the service water system, independently of, for example, the backflow preventers 176 and 178.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

I claim:

1. A pipe disconnector for separating a service water system from a drinking water system, the service water system being arranged to be filled or re-filled from said drinking water system, comprising:

a pipe disconnector casing having inlet port means for connecting said casing to said drinking water system, outlet port means for connecting said casing to said service water system and drain passage means for connecting said casing to a drain, said casing defining a flow passage from said inlet port means to said outlet port means, said drain passage means branching off from said flow passage, upstream and downstream backflow preventer means in said flow passage, both backflow preventer means being arranged to permit water flow in said flow path from said inlet port means to said outlet port means and to block water flow from said outlet port means to said inlet port means, said casing defining a space in said flow passage between said upstream and downstream backflow preventer means, relief valve means located in said space between said upstream and downstream backflow preventer means, movable between an open position and a closed position and exposed through said upstream backflow preventer means to water pressure from said inlet port means, said water pressure acting to urge said relief valve means towards its closed position, wherein said upstream and downstream backflow preventer means and said relief valve means are combined to form a structural unit which is designed to be set in or removed, as a whole, into or from, respectively, said flow passage of said pipe disconnector casing, said relief valve means comprises a sleeve shaped slide valve body having a cylindrical peripheral surface and having an upstream end with an upstream end face and a downstream end with a downstream end face, said upstream end face being exposed through said upstream backflow preventer means to water pressure from said inlet port means, and said downstream end face being exposed to pressure in said space between said upstream and downstream backflow preventer means, said slide valve body is slidable in said flow passage between an open position and a closed position under the action of a pressure difference between said pressures in said inlet port means and said space, said slide valve body, in its closed position, covering said drain passage means, said pipe disconnector casing includes two spaced sealing rings retained therein and surrounding said flow passage, said slide valve body being guided, with said peripheral surface by said two sealing rings, said drain passage means being defined between said sealing rings;

said upstream backflow preventer is mounted within said slide valve body, the pressure in the drinking water system required for opening the upstream backflow preventer means is larger than the pressure required for closing the relief valve, said downstream backflow preventer means comprises a jacket surrounding a backflow preventer check valve, said jacket having a downstream end and a flange with a circular array of recesses at said downstream end, said slide valve body, at its downstream end, has a circumferential array of axial, resilient fingers, which are guided in said recesses of said flange, and have inside lugs, said fingers being spring biased, whereby said lugs snap behind said flange, and a compression spring is supported on said flange and engages said slide valve body to generate a bias towards said open position.

2. A valve assembly as claimed in claim 1, wherein said flange is crenellated with radially outwardly extending projections and said recesses therebetween, the spring biased fingers extending through said recesses between said projections.

3. A pipe disconnector assembly for separating a service water system to be filled or re-filled from a drinking water system from said drinking water system, comprising:

a pipe disconnector casing having inlet port means and outlet port means for installing said casing between said drinking water system and said service water system and defining a flow path therethrough, said inlet port means being provided on an inlet side of said casing and said outlet port means being provided on an opposite outlet side of said casing in alignment with said inlet port means, said inlet port means and said outlet port means defining a common port axis, an accommodation bore provided in said casing and defining a bore axis, said bore axis forming an angle with said common port axis, said accommodation bore, on one hand, communicating directly with said outlet port means, on said outlet side, and, on the other hand, communicating with said inlet port means, through a connection passage, on said inlet side, said accommodation bore being open on the inlet side and being closed by a removable plug, pipe disconnector means comprising upstream backflow preventer means, relief valve means and downstream backflow preventer means being accommodated in series in a flow path within said accommodation bore, and drain passage means branching off from said accommodation bore, said drain passage means being governed by said relief valve means.

4. A pipe disconnector assembly as claimed in claim 3, wherein said upstream and downstream backflow preventer means and said relief valve means are assembled to form a unit, which is adapted to be inserted into or removed from said accommodation bore, as a whole, said upstream and downstream backflow preventer means defining a space therebetween, and said relief valve means comprise slide valve means having a first end face on one side and a second end face on the opposite side, said first end face being exposed to drinking water pressure and said second end face being exposed to said space between said upstream and downstream backflow preventer means.

5. A pipe disconnector assembly as claimed in claim 3, and further comprising a shut-off valve and a pressure reducer means integrated in said pressure disconnector casing in said flow path upstream of said upstream backflow preventer means.

6. A pipe disconnector assembly as claimed in claim 5, wherein said pressure reducer means are arranged in said connecting passage.

7. A pipe disconnector assembly as claimed in claim 6, wherein said pipe disconnector casing defines an inlet passage in said flow path directly downstream of said inlet port means, said shut-off valve being a ball valve arranged in said inlet passage on said common port axis of said inlet and outlet port means.

8. A pipe disconnector assembly as claimed in claim 7, wherein said pipe disconnector casing has a socket integral therewith, said socket defining a substantially cylindrical accommodation cavity therein with a substantially cylindrical inner surface, said connecting socket comprises a first section and a second section, said first section extending from said inlet passage downstream of said ball valve and opening in an upper portion of said cylindrical inner surface, said second section of said connecting socket extends from a lower portion of said cylindrical inner surface and opens into said accommodation bore upstream of said upstream backflow preventer means, and said pressure reducer means forms an integral unit and is inserted into said accommodation cavity of said socket.

9. A pipe disconnector assembly as claimed in claim 8, wherein said two sections of said connecting passage are substantially parallel and form an angle with said common port axis.

10. A pipe disconnector assembly as claimed in claim 3, wherein said pipe disconnector casing has first test tap means communicating with said flow path upstream of said upstream backflow preventer means and permitting connection of pressure gage means for measuring an inlet pressure, second test tap means communicating with said flow path intermediate said upstream and downstream backflow preventer means and permitting connection of pressure gage means for measuring a median pressure, and third test tap means communicating with said flow path downstream of said downstream backflow preventer means and permitting connection of pressure gage means for measuring an outlet pressure.

* * * * *